United States Patent [19]

Sauer et al.

[11] 4,296,393

[45] Oct. 20, 1981

[54] CONTACT SPRING ARRANGEMENT FOR AN ELECTROMAGNETIC RELAY

[76] Inventors: Hans Sauer, Fichtenstrasse 5, Deisenhofen, Fed. Rep. of Germany, D-8024; Wolf Steinbichler, Am Hoehenpark, Bad Feilnbach, Fed. Rep. of Germany, D-8201; Sepp Antonitsch, Holzham 2d, Otterfing, Fed. Rep. of Germany, D-8156

[21] Appl. No.: 115,093

[22] Filed: Jan. 24, 1980

[30] Foreign Application Priority Data

Jan. 25, 1979 [DE] Fed. Rep. of Germany ..... 2902885

[51] Int. Cl.[3] ..... H01H 67/02

[52] U.S. Cl. ..... 335/125; 335/128

[58] Field of Search ..... 335/78, 79, 80, 81, 335/106, 124, 125, 127, 128, 133

[56] References Cited

U.S. PATENT DOCUMENTS

| | | | |
|---|---|---|---|
| 3,321,722 | 5/1967 | Cohen | 335/128 |
| 3,634,793 | 1/1972 | Sauer | 335/78 |
| 3,946,347 | 3/1976 | Sauer | 335/78 X |
| 3,993,971 | 11/1976 | Ono et al. | 335/125 X |

*Primary Examiner*—George Harris

*Attorney, Agent, or Firm*—Schwartz, Jeffery, Schwaab, Mack, Blumenthal & Koch

[57] ABSTRACT

A contact spring arrangement for an electromagnetic relay includes a contact spring forming at least one movable contact for cooperation with a fixed contact, and an actuator which embraces the contact spring and has a first portion for moving the movable contact towards the fixed contact, thereby closing the contact couple, and a second portion for withdrawing the movable contact from the fixed contact, thereby opening the contact couple. The actuator is so shaped that the distance between the location at which the first actuator portion engages the contact spring and the contacting location of the contact couple is greater than the distance between the location at which the second actuator portion engages the contact spring and the said contacting location. As a result, in the closed condition of the contact pair, the first actuator portion will be able to bend the contact spring to provide sufficient resilient contact force, whereas, in the opening of the contact couple, the second actuator portion will entrain the contact spring with very little resiliency of the contact spring, thus tending to tear the contact couple apart even in case sticking or welding should have occurred between the fixed and movable contacts.

13 Claims, 6 Drawing Figures

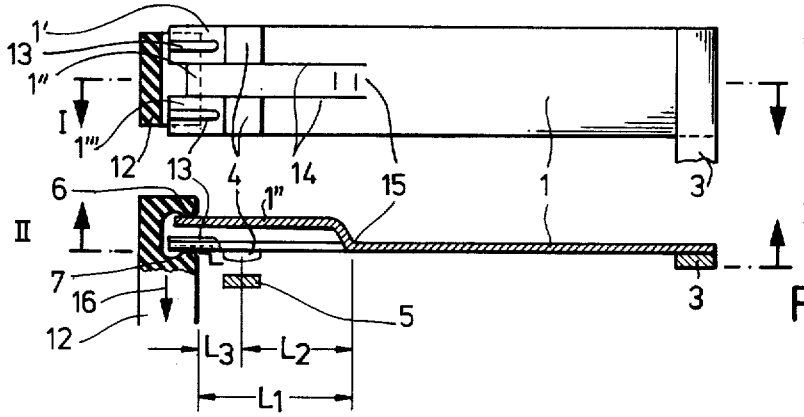
FIG.1a
FIG.1b
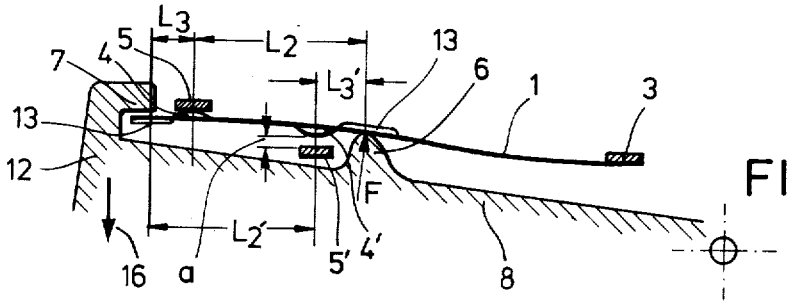
FIG.2
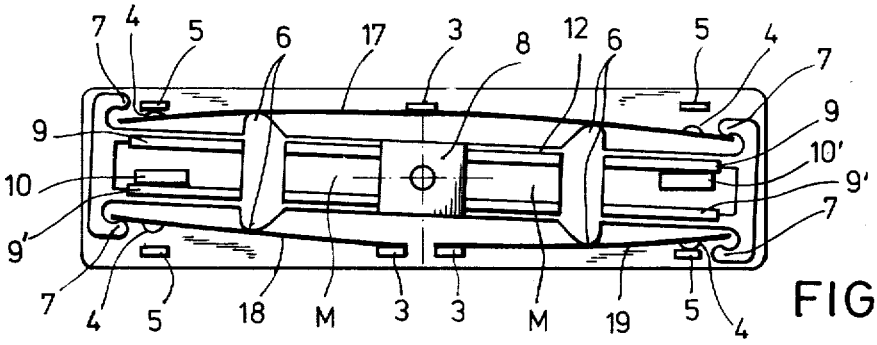
FIG.3
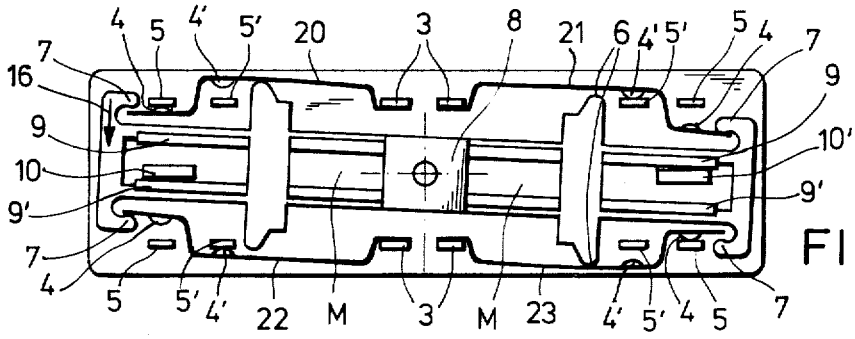
FIG.4

CONTACT SPRING ARRANGEMENT FOR AN ELECTROMAGNETIC RELAY

BACKGROUND OF THE INVENTION

In the contact spring arrangement disclosed in German patent specification No. 1,213,917, a substantial portion of the force exerted on the armature by a permanent magnet is stored in a double contact spring. Accordingly, practically no excitation energy is required to provide the contact force. In the known arrangement, an actuating nipple is disposed between the free ends of a bifurcated spring which has the same flexibility in both directions of its actuation. It is necessary that the path of travel of the armature is greater than the contact clearance by the travelling distance required by the spring in either direction of actuation. Furthermore, since the bifurcated spring ends exhibit the same flexibility at the opening as at the closing of the contact couple, there is a danger that a contact couple of the relay is closed while another contact couple has become stuck or welded together.

In view of this problem, German Auslegeschrift No. 2,454,967 suggests an arrangement in which the contact couple is positively and forcibly opened, whereas the closing of the contact couple is done solely by tensioning the contact spring. However, this arrangement allows only a small proportion of the pull provided by the armature to be stored in the contact spring.

It is an object of the present invention to provide a contact spring arrangement in which, in case of a sticking of the contact couple, the contact spring will not substantially be bent by the actuation of the armature to open the contact, while a bending of the contact spring is ensured in the closed condition of the contact couple.

It is a further object of the present invention to provide an arrangement as set forth above, which is easy to manufacture and assemble with a minimum of structural components.

SUMMARY OF THE INVENTION

The contact spring arrangement for an electromagnetic relay according to the invention includes a contact spring mounted on a terminal and having at least one portion serving as a movable contact cooperating with a fixed contact, and an actuator engaging the contact spring and having a first actuator portion for moving the movable contact towards the fixed contact and a second actuator portion for withdrawing the movable contact from the fixed contact, a first distance between the location at which the first actuator portion engages the contact spring and the contacting location of the movable and fixed contacts being greater than a second distance between the location at which the second actuator portion engages the contact spring and said contacting location.

Such an arrangement provides wide spring excursions during the closing of the contact couple, while the opening is done positively and forcibly by actuation of the contact spring in the immediate vicinity of the movable contact. To obtain as little bending as possible, the distance between the location of engagement of the second actuator portion and the movable contact is as short as possible. Alternatively or additionally, the corresponding portion of the contact spring may be stiffened by a profile embossed in the contact spring.

Due to the wide spring excursions during the closing of the contact couple, the contact spring arrangement of the present invention is particularly advantageous in polarized relays, in which the force exerted by the armature rises with increasing deflection progressively from a zero value of the permanent-magnetic force up to a final pull and is reduced by the resiliency of the contact spring or springs. The wide spring excursion is furthermore advantageous as it provides a good reproducibility of the storing of permanent magnetic force in the contact spring with the result that the desired contact force may be set within a small range.

BRIEF DESCRIPTION OF THE DRAWINGS

FIG. 1*a* is a plan view taken along the line II—II in FIG. 1*b* of a contact spring having its free end divided in three sections, FIG. 1*b* is a cross-section of the contact spring taken along the line I—I in FIG. 1*a*;

FIG. 2 is a cross-sectional view of another contact spring cooperating with two fixed contacts;

FIG. 3 shows a relay with a rotary armature and one normally closed contact, one normally open contact and one double-throw contact;

FIG. 4 shows a relay with a rotary armature and four double-throw contacts.

DESCRIPTION OF PREFERRED EMBODIMENTS

Figure 5:
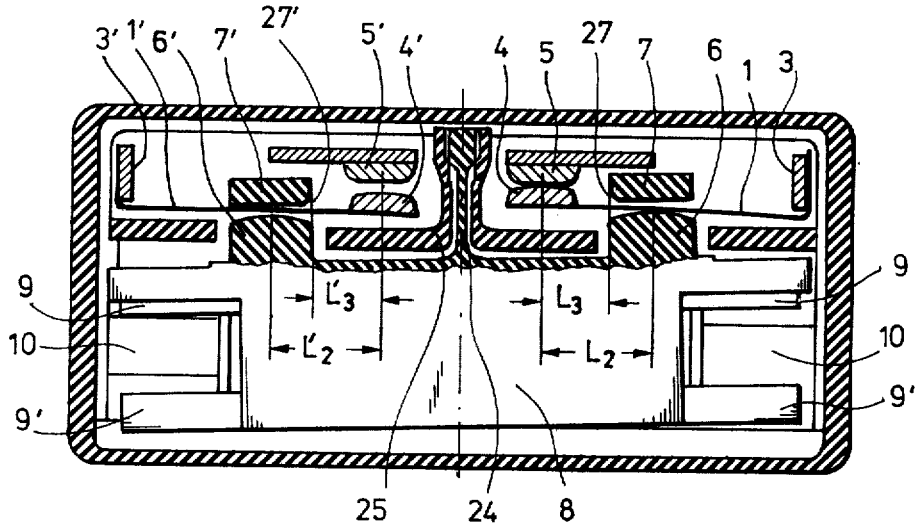
FIG. 5 shows in partial cross-section another relay with a rotary armature, one normally closed contact and one normally open contact.

In the embodiment shown in FIGS. 1*a* and 1*b*, the contact spring 1 has it free end divided into three sections 1', 1'' and 1''' by cuts 14 extending in the longitudinal direction of the spring. The other end of the contact spring 1 is fixed to a terminal 3. The contact spring sections are spread apart and biassed against each other by first and second acutator portions 6,7 to provide a certain bias contact force. The two outer sections 1' and 1''' extend substantially longitudinally of the contact spring, are provided with contact material to form movable contacts 4 at regions opposite a fixed contact 5 and have their ends abutting the second actuator portion 7. The central contact spring section 1'' is bent with respect to the outer sections 1' and 1''', extends essentially parallel thereto and has its end abutting the first actuator portion 6 of the actuator 12, to achieve the bias contact force. The effective length contributing to the resiliency in the closing of the contact couple 4,5 is defined by the sum of the distance L1 between the location of engagement of the first actuator portion 6 and the foot 15 of the spring section 1' and 1''' of the contact spring 1 and the difference L2 between the foot 15 and the contact location.

The contact spring 1 shown in FIGS. 1*a* and 1*b* is actuated in the direction of the arrow 16 in FIG. 1*b* by an armature (not shown) driving the actuator 12. During such movement, the actuator portion 6 presses against the end of the resilient contact spring section 1'' and urges the movable contact 4 into engagement with the fixed contact 5. The bias contact force provided by the resilient section 1'' during the closing of the contact couple tends to avoid chattering. During closing, the resilient total length L1+L2 is effective. The resultant wide spring excursion permits a storing of the positioning force of the armature in the contact spring 1 in case this positioning force is produced by a permanent magnet. The stored force defines the contact force.

In opening the contact couple 4,5 the actuator portion 7 presses against the sections 1', 1'''. Since the distance L3 between the engaging location of the contact portion 7 and the contacting location is made as short as possible, the bending of the sections 1' and 1''' is relatively small, so that the contact couple is positively forced open. The sections 1', 1''' may be provided with embossed stiffening profiles 13 in order further to reduce the bending.

In the arrangement shown in FIG. 2, one fixed contact 5, 5' is disposed on each side of the contact spring 1 in the area of the free end thereof, the two fixed contacts being mutually displaced along the longitudinal direction of the contact spring 1. The actuator portions 6, 7 of the acutator 12 are disposed in close vicinity to the fixed contact 5, 5' so that the distance L2, L2' between the engaging point of the actuator portion 6,7 serving to close the respective contact couple 5,4 or 5',4' and the respective contacting point is larger than the distance L3, L3' effective in the opening of the contact couple between the engaging point of the respective actuator portion 7, 6 and the respective contacting location. A double-throw contact system is thus realized by simple means, in which the closing of the contacts is done by the long resilient distances L2, L2', while the opening is performed forcibly through the short and thus stiff lengths L3, L3'. Again, the spring 1 may have embossed profiles 13 for stiffening the lengths L3, L3'. The contact spring 1 is actuated e.g. by a rotary armature 8 partially shown in FIG. 2.

In detail, the first actuator portion 6 engages the contact spring 1 between the location at which the contact spring 1 is connected to the terminal 3 and the fixed contact 5' which is disposed closer to the terminal 3, in close proximity to this first fixed contact 5', while the second actuator portion 7 engages the contact spring 1 at the free end thereof extended beyond the fixed contact 5 remote from the terminal 3 in close proximity to this second fixed contact 5. A positively and forcibly actuated contact spring is thus obtained which requires no adjustment. In the position shown in FIG. 2, the contact couple 4,5 has been closed by means of the actuator portion 6 which applies a force F on the contact spring 1. Should the contact couple 4,5 become welded together in this position due to overload so that it cannot be torn open when the armature 8 intends to move in the direction of the arrow 16, the clearance a of the contact couple 4',5' is not reduced, but rather enlarged, by the action of the actuator portion 7 engaging the free end of the contact spring. This contact arrangement is therefore particularly suited for applications which required increased contact security by positive guidance of the contact spring. In addition, the contacts 4,5 and 4',5' will wear off during their lives, resulting in an increased clearance a, so that the positive and forced actuation of the contact couples is ensured over the entire life of the arrangement.

FIG. 3 shows a relay having a rotary armature, a double-throw contact provided by the contact spring 17, a normally open contact provided by the contact spring 18, and a normally closed contact provided by the contact spring 19. The contact springs 17 to 19 are actuated by actuator portions 6,7 of an actuator 12 entrained by the rotary armature 8. The armature furthermore includes permanent magnets M and two pole shoes 9, 9' cooperating with pole ends 10,10' of a coil core. Each contact spring 17,18,19 cooperates with one single fixed contact 5 provided in the zone of the free spring end. The first actuator portion 6 engages each contact spring 17,18,19 between the location at which the respective spring is connected to its terminal 3 and the contacting position on the side of the contact spring remote from the associated fixed contact 5, while the second actuator portion 7 engages the respective contact spring 17, 18, 19 at its side facing the fixed contact 5 and at the end of the contact spring extended beyond the fixed contact 5 in close proximity thereof. The actuator 12 is shaped so that the points of engagement of all actuator portions 6,7 lying on the same side of the armature 8 are disposed on a straight line.

A relay with forcibly actuated contact couples is thus obtained which requires no adjustment. In case any contact couple should become welded together, the then existing switching condition is retained for all contact couples, unless the welded contact couple is torn open upon re-actuation of the relay. The contact force is derived from the force of the permanent magnets M and stored in the contact springs 17 to 19 due to the wide spring excursion effective during the closing of contacts. For stiffening the short spring end effective in the forced contact opening, the contact springs may again be provided with an embossed profile in the respective areas.

The relay shown in FIG. 4 has four double-throw contacts 20,21,22, and 23 which principally correspond to the double-throw contact of FIG. 2. The magnet system essentially corresponds to that shown in FIG. 3, and like details are provided with the same reference numbers. While in FIG. 2 a straight contact spring 1 is disposed between mutually offset fixed contacts 5,5', the terminals 3 of the double-throw contact springs 20,21 and 22,23 and the fixed contacts 5 and 5' are disposed on straight lines on either side of the armature, the contact springs being provided with a double-bend and so passed through the fixed contacts.

Since the contact springs are guided from both sides, adjustment is again superfluous. In the closing of contacts, substantial spring lengths are provided between the engaging location of the respective actuator portion 6,7 and the contacting portion 4,5 or 4',5' in both actuation directions, which again results in the possibility to store the permanent-magnetic pull in the contact springs. This storage of permanent-magnetic force further allows a compensation of the temperature coefficient of the coil. For this purpose, permanent magnets M are provided in which the influence of the temperature coefficient on the positioning force of the armature is greater—due to the storing effect of the contact springs—than the permanent-magnetic field. Such action may be obtained e.g. by the use of BaOFe magnets. The contact couples 4,5, e.g. at the upper left and lower right corners of the relay shown in FIG. 4, are forcibly opened by rotating the armature 8 in the direction of the arrow 16, just as in the previous embodiments. In case any contact couple 4,5 should have become welded together and the positioning force of the armature 8 should be insufficient to tear the welded contact couple open, the armature will not move. The existing switching condition will then be retained for all contact couples 4,5 and 4',5'.

In the rotary armature relay shown in FIG. 5, the armature includes a permanent magnet and is pivoted on one side in a bearing block 25 by means of a flexible web 24. The web 24 is integrally formed with an insulating envelope of the armature, just as are the actuator portions 6,6', 7,7'. The insulating envelope also serves to fasten at least one permanent magnet (not shown) and pole shoes 9,9' to the armature, the pole shoes cooperating with pole ends 10,10' of a coil core. The actuator portions 6,7 and 6',7' shown in cross-section are connected to each other at their upper sides and thus straddle the contact springs 1 and 1'.

In the position shown in FIG. 5, the right-hand contact couple 4,5 is closed and the left-hand contact couple 4',5' is open. In the closed position, the rounded surface of the actuator portion 6 presses against the contact spring 1, while the opposite actuator portion 7 is spaced from the spring. In accordance with the relatively great spring length L2, the contact spring 1 is thereby substantially bent. On the other hand, the open position of the left-hand contact couple 4',5' is achieved by the effect of the actuator portion 7' engaging the contact spring 1', whereas the actuator portion 6' is spaced from the spring 1'. At the beginning of the opening process, the corner 27,27' on the side of the respective actuator portion 7,7' facing the contact engages the respective contact spring 1,1', so that the short spring length L3, L'3 between the corner and the contact location is effective. When the opening movement proceeds, the location at which the actuator portion 7, 7' engages the respective contact spring moves along the contact spring, because the surface of the actuator portion facing the contact spring extends parallel to the longitudinal axis of the armature 7 from the corner of the actuator portion facing the contact to the corner remote from the contact. The present embodiment again guarantees that the contact closing is done through the large spring lengths L2, L'2, while the contact opening is performed forcibly by the short, thus stiff lengths L3, L'3.

Due to the large spring excursion in the contact closing, a large proportion of the permanent-magnetic pull is stored in the contact springs 1 or 1', respectively. On the other hand, the small resiliency of the contact springs in the contact opening will tend to tear apart any contact couple that may have become welded, in which case the other contact couple is properly actuated; otherwise, when the welded contact couple cannot be torn open, operation of the other contact couple will be prevented.

We claim:

1. A contact spring arrangement for an electromagnetic relay including (a) a contact spring mounted on a terminal and having at least one portion serving as a movable contact cooperating with a fixed contact, and (b) an actuator engaging the contact spring and having a first actuator portion for moving the movable contact towards the fixed contact and a second actuator portion for withdrawing the movable contact from the fixed contact, (c) a first distance between the location at which the first actuator portion engages the contact spring and the contacting location of the movable and fixed contacts being greater than a second distance between the location at which the second actuator portion engages the contact spring and said contacting location.

2. The arrangement of claim 1, wherein a free end of the contact spring has at least one longitudinally extending cut forming two spring sections which are spread apart and biassed towards each other by said first and second actuator portions, to provide a bias contact force.

3. The arrangement of claim 2, wherein said free end of the contact spring is divided in three spring sections, the two outer spring sections extending substantially longitudinally of the contact spring, each outer spring section forming part of said movable contact and having its free end engaging said second actuator portion, and the inner spring section being spaced from, and extending substantially parallel to, said outer spring sections and having its free end engaging said first actuator portion.

4. The arrangement of claim 2, wherein said first distance is defined by the sum of the distance between the engaging location of said first actuator portion and the inner end of said slot and the distance between said inner slot end and said contacting location.

5. The arrangement of claim 1, wherein said contact spring has two portions forming first and second movable contacts on opposite sides of the contact spring and spaced apart along the contact spring to cooperate with first and second fixed contacts, respectively, said first and second actuator portions engaging said contact spring at locations situated in close proximity of said first and second movable contacts.

6. The arrangement of claim 5, wherein one of said first and second actuator portions engages the contact spring between said contact spring terminal and that one of said first and second movable contacts which is closer to said terminal, the other actuator portion engaging the contact spring at the side of the other movable contact remote from said terminal.

7. The arrangement of claim 1, wherein the contact spring has near its free end one single portion serving as a movable contact, said first actuator portion engaging the contact spring at the side opposite the fixed contact between the movable contact and said contact spring terminal, and the other actuator portion engaging the contact spring at said free end thereof on the side facing the fixed contact.

8. The arrangement of claim 1, wherein said actuator is pivotable about its center between first and second end positions, said fixed contact and said contact spring terminal defining a first straight line extending parallel to an axis representing a central position of the actuator intermediate said end positions, and the locations at which said first and second actuator portions engage the contact spring forming a second straight line extending parallel to said first straight line when the actuator is in its central position.

9. The arrangement of claim 5, wherein said first and second fixed contacts and said contact spring terminal are disposed along a straight line, the contact spring having a double-bend between said first and second movable contacts.

10. The arrangement of claim 1, including means for stiffening the portion of the contact spring defining said first distance.

11. The arrangement of claim 10, wherein said stiffening means includes a longitudinal groove formed in the contact spring.

12. The arrangement of claim 1, wherein the force exerted on the contact spring by the actuator increases progressively from a zero value of the permanent-magnetic force to a final value, and is reduced by the resiliency of the contact spring.

13. The arrangement of claim 1, wherein said second actuator portion has a section extending substantially parallel to the contact spring, the location of engagement between the contact spring and said second actuator portion travelling from the end of said section adjacent said contacting location towards the end of said section remote from said contacting location during withdrawal of the movable contact from the fixed contact.

* * * * *